United States Patent [19]

Goldfinger

[11] 4,390,087

[45] Jun. 28, 1983

[54] GARMENT CARRYING DEVICE

[76] Inventor: Paul Goldfinger, 4243 Howe St., Oakland, Calif. 94611

[21] Appl. No.: 299,725

[22] Filed: Sep. 8, 1981

[51] Int. Cl.[3] ..... A45C 13/00; A45C 13/26

[52] U.S. Cl. ..... 190/41 B; 190/57

[58] Field of Search ..... 190/41 R, 41 B, 41 Z, 190/57; 206/280, 287

[56] References Cited

U.S. PATENT DOCUMENTS

| | | | |
|---|---|---|---|
| 1,532,046 | 3/1925 | Deiss | 206/280 |
| 1,930,043 | 10/1933 | Evens | 190/41 B |
| 2,562,444 | 7/1951 | Beer | 206/287 X |
| 2,745,524 | 5/1956 | Plotkin | 190/57 |
| 3,559,777 | 2/1971 | Gardner | 190/41 B X |
| 3,612,232 | 10/1971 | Larson | 190/41 B X |
| 3,743,083 | 7/1973 | James | 206/287 |
| 3,744,600 | 7/1973 | Belland et al. | 190/41 B |
| 3,809,194 | 5/1974 | Chappelle et al. | 190/41 B |
| 3,831,740 | 8/1974 | Pendergast et al. | 190/41 Z X |
| 4,252,220 | 2/1981 | London et al. | 190/41 B |

*Primary Examiner*—William Price

*Assistant Examiner*—Sue A. Weaver

[57] ABSTRACT

A garment carrying device utilizing a frame member which is attached to the first end portion of a strap. A second end portion of the strap attaches to the frame member at a point remote from the attachment of the first end portion of the same. An enclosure for covering at least a portion of the garment surrounds at least a portion of the frame.

5 Claims, 4 Drawing Figures

GARMENT CARRYING DEVICE

BACKGROUND OF THE INVENTION

The present invention relates to a novel garment carrying device which is especially useful for carrying clothing.

Garment bags of known configuration have been used to carry clothing without folding or rolling the same into a smaller volume. Various configurations of a basic garment bag have been proposed. For example, U.S. Pat. No. 2,562,444 describes a garment bag having an internal frame to prevent the hanger portion from falling to the bottom of the bag. U.S. Pat. No. 3,559,777 depicts a garment bag which is completely flexible as to be foldable for easy storage in a vehicle.

It seems that garment bags in the past have had problems where the hangers being used for the garments stored within the bag extend to the outside of the bag at the top portion of the garment bag. Reference is made to U.S. Pat. Nos. 3,743,083, 3,809,194, and 3,831,740, which depict various straps to be used in conjunction with the hangers for the garments. On the other hand, U.S. Pat. No. 3,744,600 utilizes a unitary hanger which functions to hold the garment hangers within the bag.

It is not known that any of the garment bags of the prior art permits the user to easily carry the same without using the fingers of the hand for grasping the bag.

SUMMARY OF THE INVENTION

In accordance with the present invention a novel and useful garment carrying device is provided which permits the user to carry the same without gripping the carrying device.

The garment carrying device of the present invention utilizes a frame member which is connected to a first end portion of the strap by means provided for accomplishing the same. The second end portion of the strap is also attached to the frame member at a place remote from the attachment of the first end portion to the frame member. An enclosure for covering at least a portion of the garment is provided and at least partially surrounds the frame member. Means is also provided for holding the second end portion of the strap to the frame and may function to hold a portion of the enclosure therebetween. In addition, means for holding the second end portion of the strap to the frame member may include means for removably connecting the second end portion of the strap to a plurality of places on the frame member. By this structure, one is able to provide a strap loop which may be used by either left or right-handed persons.

The garment carrying device also may embrace a hook connected to the frame member which extends outwardly from the enclosure. Such hook may be easily fastened to the frame member by any known means and may be constructed of a material which is stronger than the frame member.

An arm may be connected to the frame and connected hook on the inside of the enclosure for providing a support for the hangers used with the garments being carried. The arm may take the form of a closed loop such that a first and second end portion of the same are connected to the frame and connected hook unit. The first end portion of the strap, frame member and connected hook, arm, and enclosure for the garments may be sandwiched together by a fastener.

It may be apparent that a novel and useful garment carrying device has been described.

It is therefore an object of the present invention to provide a garment carrying device which is simple and inexpensive to manufacture.

It is another object of the present invention to provide a garment carrying device which may be easily carried over the shoulder of the user leaving both hands of the user free.

It is yet another object of the present invention to provide a garment carrying device which includes a hook or hanger apart from the garment hangers which may be employed to hold the entire carrying device to an elevated member.

Another object of the present invention is to provide a garment carrying device which may be carried over the shoulder of the user and is adjustable for use by either left or right-handed persons.

The invention possesses other object and advantages especially as concerns particular characteristics and features thereof, which will become apparent as the specification continues.

For a better understanding of the invention reference is made to the hereinafter described embodiments.

DESCRIPTION OF THE PREFERRED EMBODIMENTS

Various aspects of the present invention will evolve from the following detailed description of the preferred embodiments thereof which should be taken in conjunction with the hereinabove described drawings.

Figure 2:
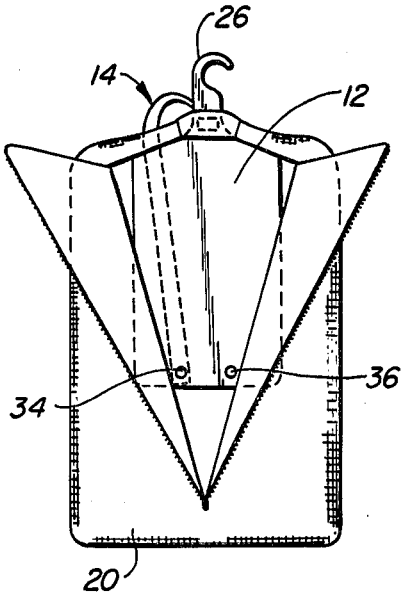
FIG. 2 is a front elevational view of the device with the garment bag partially opened.

The invention as a whole is represented by reference character 10. The device 10 includes a frame member 12 which may be constructed of any flexible, semi-rigid, or rigid material such as a plastic, metal, or the like. Frame member 12 may take the form of a rectangular solid as shown in FIG. 2 but may be constructed in any configuration. A strap 14 includes a first end portion 16 and a second end portion 18. Strap 14 may be padded for easing the pressure caused by the weight of device 10 on the user thereof. An enclosure 20 may be constructed of cloth-like material in the conventional manner. FIG. 2 depicts enclosure 20 having the ability to open by the use of a Zipper or other like means.

Figure 4:
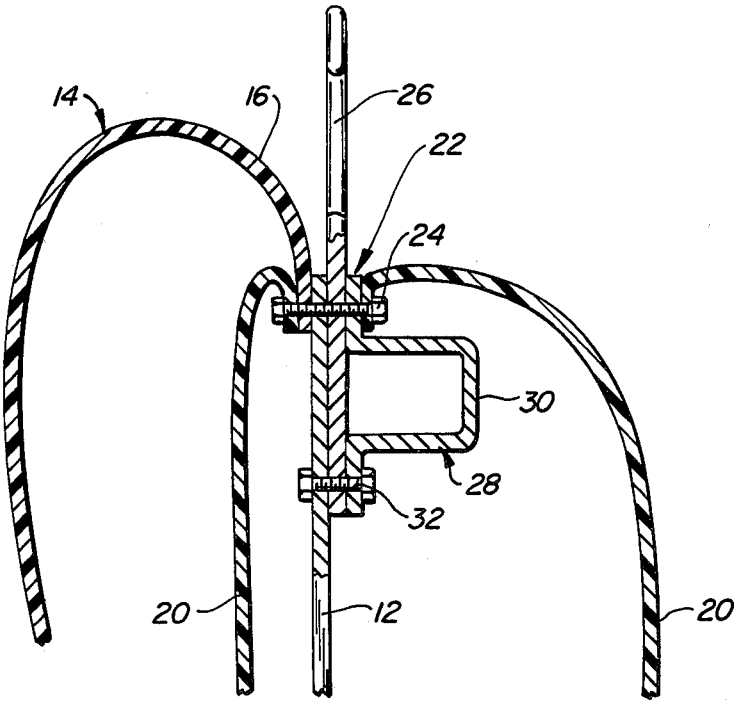
FIG. 4 is a partially broken sectional view of the device showing an enlarged portion of the sectional view at the upper portion of FIG. 3.

Means 22 may be employed to hold first end portion 16 of strap 14 to frame member 12. As shown in FIG. 4, means 22 includes a bolt 24 which passes through frame member 12, first end portion of strap 14, and enclosure 20. It should be noted that an order of proximity of these elements may be altered without undermining the basic idea described herein. It may be apparent from FIG. 4 that means 22 also holds a hanger or hook 26 as well as an arm 28 formed into a closed loop 30. As hook 26 will receive more abuse than frame 12, hook 26 may be constructed of a material which is able to resist such abuse, for example, metal. Arm 28 may be employed to hold the hangers normally used in conjunction with clothing. Thus, none of the hangers accompanying the clothing is employed to hold or hang up device 10. Arm 28 is held to frame 12 by fastener 32 which is again depicted as a bolt. Fasteners 24 and 32 may take the form of any conventional fasteners such as a screw, clip, and the like.

Figure 1:
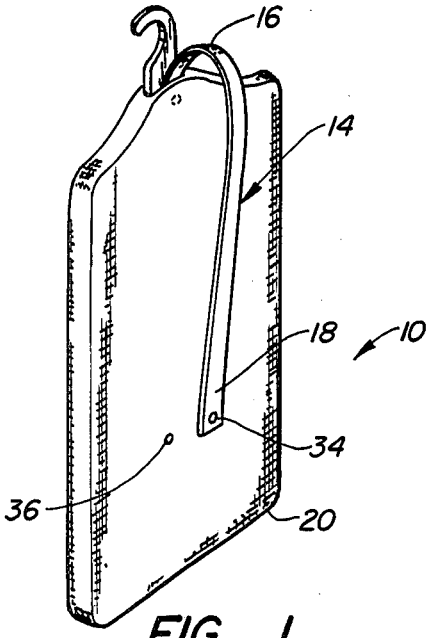
FIG. 1 is a perspective view of the device.
Figure 3:
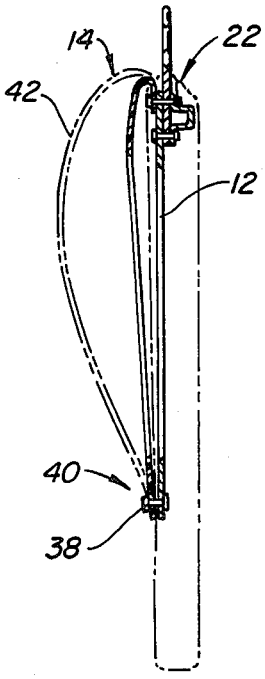
FIG. 3 is a sectional view of the device.

Returning to FIG. 1, it may be seen that strap 14 second end portion 18 is fastened to frame member 12 at fastening point 34. Fastening point 36 may also be employed to this end. FIG. 3 depicts a bolt 38 which serves as means 40 for fastening second end portion 18 of strap 14 to frame member 12. Strap 14 forms a loop 42 through which a person may pass one's arm. As shown in FIG. 1, the connection of second end portion 18 of strap 14 to fastening point 34 would present a more convenient configuration for the use of the left arm to hold device 10. The use of fastening point 36 would render device 10 more useable by a person's right arm. Bolt 38, of course, is removable and allows attachment of second end portion 18 of strap 14 to either of these two fastening points 34, 36.

In operation, the user opens bag 20 and inserts clothing using arm 28 to hold the hangers for the same. Bag 20 is then closed and may be hung on a bar or the like before movement of the same. It should be noted that hook 26 may be used to hold bag 20 in an upright position while loading the same with the clothing hereinbefore described. The user than removes hook 26 from the support and may carry device 10 by inserting a right or left arm through loop 42 formed by strap 14.

While in the foregoing embodiments of the invention have been set forth in considerable detail for the purposes of making a complete disclosure of the invention, it may be apparent to those of skill in the art that numerous changes may be made in such details without departing from the spirit and principles of the invention.

What is claimed is:

1. A hanging garment carrying device comprising:

a. a frame member defined to extend along the direction in which the garment hangs, said frame member having an upper portion and a lower portion;

b. a strap having a first end portion and a second end portion;

c. an enclosure for covering at least a portion of the garment and said frame;

d. means for holding said first end portion of said strap to said upper portion of said frame member;

e. means for holding said second end portion of said strap to said lower portion of said frame member;

f. a hook connected to said frame member and extending outwardly from said enclosure; and g. an arm connected to said frame and connected hook, said arm being capable of extending there from within said enclosure.

2. The garment carrying device of claim 1 in which said means for holding said second end portion of said strap to said lower portion of said frame member includes a portion of said enclosure being held adjacent said second end portion of said strap and said lower portion of said frame member.

3. The garment carrying device of claim 1 which said means for holding said second end portion of said strap to said lower portion of said frame member includes means for removably connecting said second end portion of said strap to a plurality of places on said lower portion of said frame member.

4. The garment carrying device of claim 1 in which said arm has a first end portion and a second end portion, said first and second end portions of said arm being connected to said frame and connected hook to form a closed loop.

5. The garment carrying device of claim 4 in which said means for holding said first end portion of said strap to said upper portion of frame includes means for holding said first end portion of said strap, said upper portion of said frame member and connected hook, said arm, and said enclosure in proximal configuration.

* * * * *